US008091355B2

(12) United States Patent
St. Aubin et al.

(10) Patent No.: US 8,091,355 B2
(45) Date of Patent: Jan. 10, 2012

(54) FLOW COMPENSATED RESTRICTIVE ORIFICE FOR OVERRUNNING LOAD PROTECTION

(75) Inventors: Joseph St. Aubin, Wahpeton, ND (US); Rodney Koch, Mooreton, ND (US); Jason Asche, Stirum, ND (US); Jeret Hoesel, Lisbon, ND (US); Todd Vanderlinde, Aberdeen, SD (US)

(73) Assignee: Clark Equipment Company, West Fargo, ND (US)

( * ) Notice: Subject to any disclaimer, the term of this patent is extended or adjusted under 35 U.S.C. 154(b) by 654 days.

(21) Appl. No.: 12/256,869

(22) Filed: Oct. 23, 2008

(65) Prior Publication Data

US 2010/0101223 A1 Apr. 29, 2010

(51) Int. Cl.
*F15B 11/06* (2006.01)
*E02F 9/22* (2006.01)

(52) U.S. Cl. ..... 60/459; 91/447

(58) Field of Classification Search ..... 60/459; 91/446, 447

See application file for complete search history.

(56) References Cited

U.S. PATENT DOCUMENTS

| | | | | |
|---|---|---|---|---|
| 3,072,107 | A | 1/1963 | Cassell | 121/46.4 |
| 3,142,342 | A | 7/1964 | Brudnak, Jr. et al. | 172/9 |
| 3,604,312 | A | 9/1971 | Plate | 91/433 |
| 4,244,275 | A | 1/1981 | Smilges | 91/420 |
| 4,665,801 | A | 5/1987 | Budzich | 91/420 |
| 4,720,975 | A | 1/1988 | Gunter | 60/442 |
| 5,129,229 | A * | 7/1992 | Nakamura et al. | 91/451 |
| 5,150,574 | A * | 9/1992 | Hirata et al. | 91/446 |
| 5,409,038 | A * | 4/1995 | Yoshida et al. | 91/446 |
| 6,318,079 | B1 | 11/2001 | Barber | 60/422 |
| 6,640,409 | B2 * | 11/2003 | Sharkness et al. | 91/420 |
| 2003/0056353 | A1 | 3/2003 | Sharkness | |

FOREIGN PATENT DOCUMENTS

| | | |
|---|---|---|
| DE | 34 22 978 | 1/1986 |
| EP | 0 427 865 | 5/1991 |
| EP | 0462590 | 12/1991 |
| JP | 2003106304 | 4/2003 |
| JP | 2007092789 | 4/2007 |
| JP | 2007092789 A * | 4/2007 |

OTHER PUBLICATIONS

International Search Report for Int'l Appln. No. PCT/US2009/061158, dated Oct. 19, 2009.

Written Opinion for Int'l Appln. No. PCT/US2009/061158, dated Oct. 19, 2009.

* cited by examiner

*Primary Examiner* — Thomas E Lazo

(74) *Attorney, Agent, or Firm* — John D. Veldhuis-Kroeze; Westman, Champlin & Kelly, P.A.

(57) ABSTRACT

A hydraulic circuit for an actuator that has a piston and piston rod that will move a load in a first direction, and which can be externally loaded in an opposite direction, includes a flow compensated valve between the actuator and a control valve. When the piston in the actuator is moved in the second opposite direction under the external load and the rate of flow of fluid out of the actuator through the flow compensated valve exceeds a selected rate, an orifice is introduced in the flow path to restrict flow from the actuator.

19 Claims, 3 Drawing Sheets

10
12
14
14
16
16
18
20
22
24
26
28
32
38
38
40
42
42
46

FLOW COMPENSATED RESTRICTIVE ORIFICE FOR OVERRUNNING LOAD PROTECTION

BACKGROUND OF THE INVENTION

The present invention relates to a flow sensitive valving arrangement which places a restrictive orifice in a hydraulic line when the flow in a line exceeds a selected rate. The flow sensitive valve is in a hydraulic line for an actuator which is at times under an external load tending to move the actuator. For example when a hydraulic actuator is used for controlling the lift arms of a loader, a loaded bucket may be lowered and tend to drop quickly under gravity and the restrictive orifice of the flow sensitive valve will act to limit the rate of descent of the bucket or other implement.

In some skid steer loader applications, a flow restrictor is placed into the line to the bases of the lift arm actuators, that is pressurized to lift a load. The line acts as a return line and connects the lift arm actuators to tank when the lift arms are lowered. When the bucket or other implement is loaded and heavy, the flow restrictor will permit the lift arm to lower without any consumption of independent hydraulic power, but when the lift arms and an empty bucket are lowered, which is the most common lift arm lowering condition, the pump will be required to provide fluid under pressure on the rod end of the lift arm actuator to overcome the flow restriction of the flow restrictor for retraction of the actuators to lower the lift arms. With a flow restrictor in the return line, lowering an empty bucket can take significant horsepower. This horsepower has to be provided by the engine of the machine for lowering the lift arms when there is little or no load on the lift arms.

SUMMARY OF THE DISCLOSURE

The present disclosure provides a flow compensated valve which controls flow from an end port of an actuator, which port is pressurized for lifting or moving loads by providing hydraulic pressure to that end port of the actuator from a main control valve. The flow compensated valve has little restriction when the actuator is being pressurized and moved to lift the load, but when the load acts to retract the actuator under gravity or another external force, there is a reverse or overrunning flow from that end port of the actuator which passes through a control orifice. When the reverse flow exceeds an acceptable rate, indicating that the velocity of retraction or reverse movement of the actuator is too high, the flow compensated valve shifts or changes flow condition or state and a flow restriction is placed into the line to prevent excessive velocity of reverse movement (dropping) of the load that is retracting or reversing the actuator.

The flow compensated valve is made so that it maintains substantially the same retraction or reverse velocity of the load regardless of the amount of load. When there is only a small load tending to retract the actuator, the flow compensated valve will not shift and the actuator will retract at a normal or acceptable speed. However, if there is a high load tending to retract the actuator flow through the flow compensated valve becomes high, and the back pressure created by a control orifice will shift or change the state of the flow compensated valve to increase the retraction or reverse flow restriction and maintain a reasonable actuator and load dropping retraction velocity.

The use of the flow compensated valve that provides an additional restriction to control reverse movement of an actuator from a reverse load has advantages of reducing the hydraulic system heat that is generated, because when retracting under a light load the restriction will be minimal, meaning less heat will be generated. Since engine power is no longer required to lower or reverse a light load, such as with an empty bucket of a loader, there is improved engine efficiency and also improved engine performance because the engine horsepower that would be used for lowering or reversing the load and reversing the actuator under light load can be used for other functions such as the drive system for a loader.

In cases where there is a parallel valve system on a loader, using parallel valve arrangements for lift actuators and bucket tilt actuators, the pump size can be reduced because of the elimination of the need for using hydraulic fluid under pressure from a driven pump to reverse the lift actuator. The oil flow to the rod end of the actuator when oil is flowing out of the base end, can be provided through a standard anti-cavitation valve so that make up oil would be drawn right from the tank, not from pump flow, as the actuator retracts.

DETAILED DESCRIPTION OF EXEMPLARY EMBODIMENTS

Figure 1:
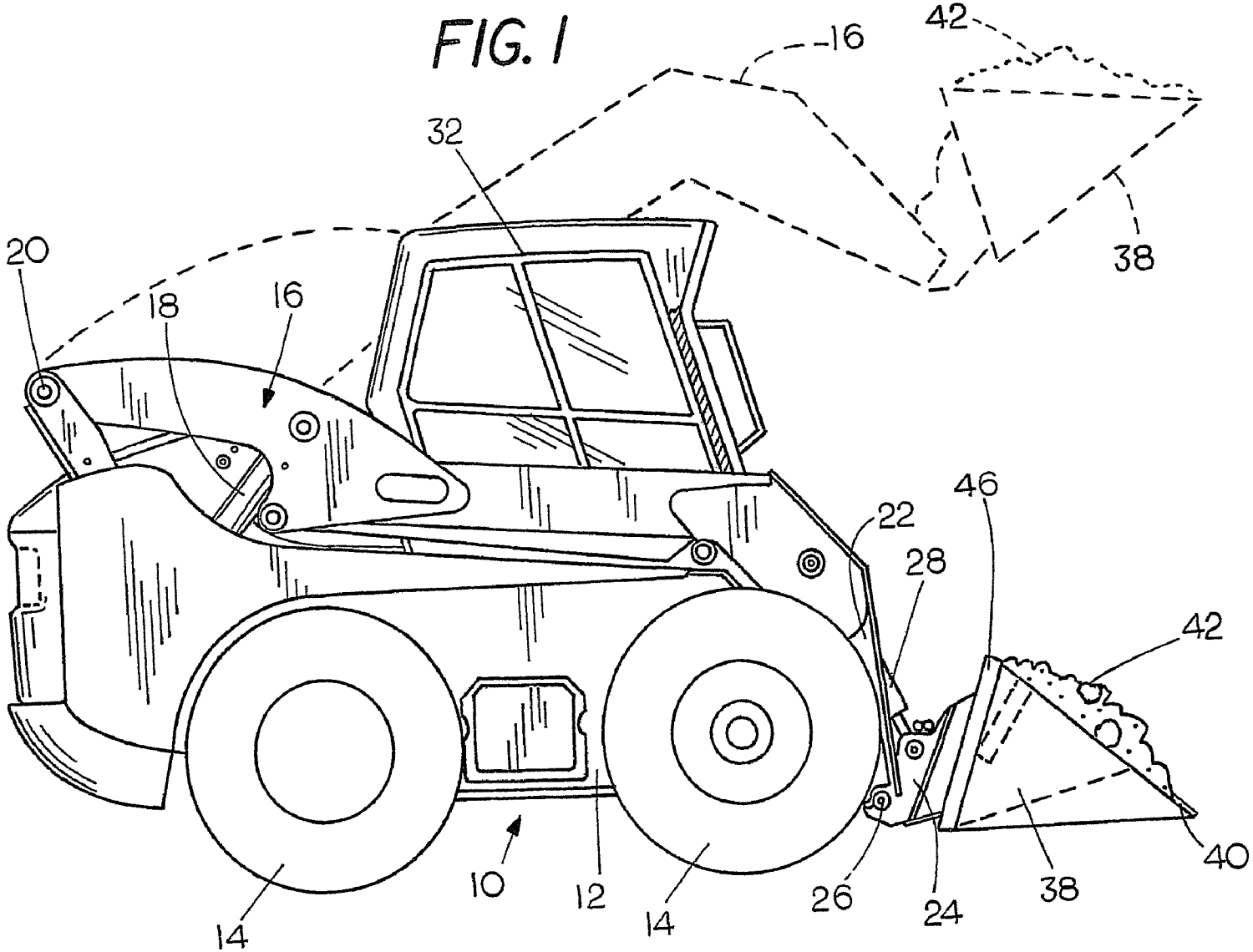
FIG. 1 is a side view of a compact loader having lift arms operated with an actuator using a flow compensated valve of the present disclosure in the hydraulic circuit.

In FIG. 1 a compact tool carrier, comprising a compact loader 10 is illustrated. This is an exemplary showing of a typical loader with which the present flow compensated valve would be utilized. Loader 10 has a transmission case or frame 12 having drive components for wheels 14 for movement across the ground. The loader includes a lift arm assembly 16 which has lift arms on opposite sides of the loader frame, and the lift arms are raisable and lowerable by operating hydraulic actuators 18 on opposite sides of the machine for pivoting the lift arm assembly at pivots 20 between raised and lowered positions in a normal manner. A raised position is illustrated in dotted lines.

The forward ends of the lift arms indicated at 22 have a tilting attachment plate 24 pivotably mounted at 26 at the forward ends of the arms. Tilting of the attachment plate is controlled by a tilt actuator or cylinder 28 operated through suitable valves. The tilt actuator 28 is a hydraulic cylinder, and it can be extended and retracted to tilt loader bucket 38. The loader bucket is held onto the tilting plate 24 in a normal manner such as that used on skid steer loaders sold under the trademark BOBCAT. The bucket has a forward edge blade 40 for digging and loading the bucket with dirt and the like, and a typical load is illustrated at dotted lines 42. When the load is dirt and rocks, the load is fairly heavy.

The loader 10 has an operator's cab 32 installed thereon, and controls for operating the loader are on the interior of the operator's cab.

The loaders of this type generally have hydraulic drive motors, one for the front and rear wheels on each side of the loader. In addition, a loader engine drives pumps for providing hydraulic power for the lift cylinders, and tilt cylinders.

Figure 2:
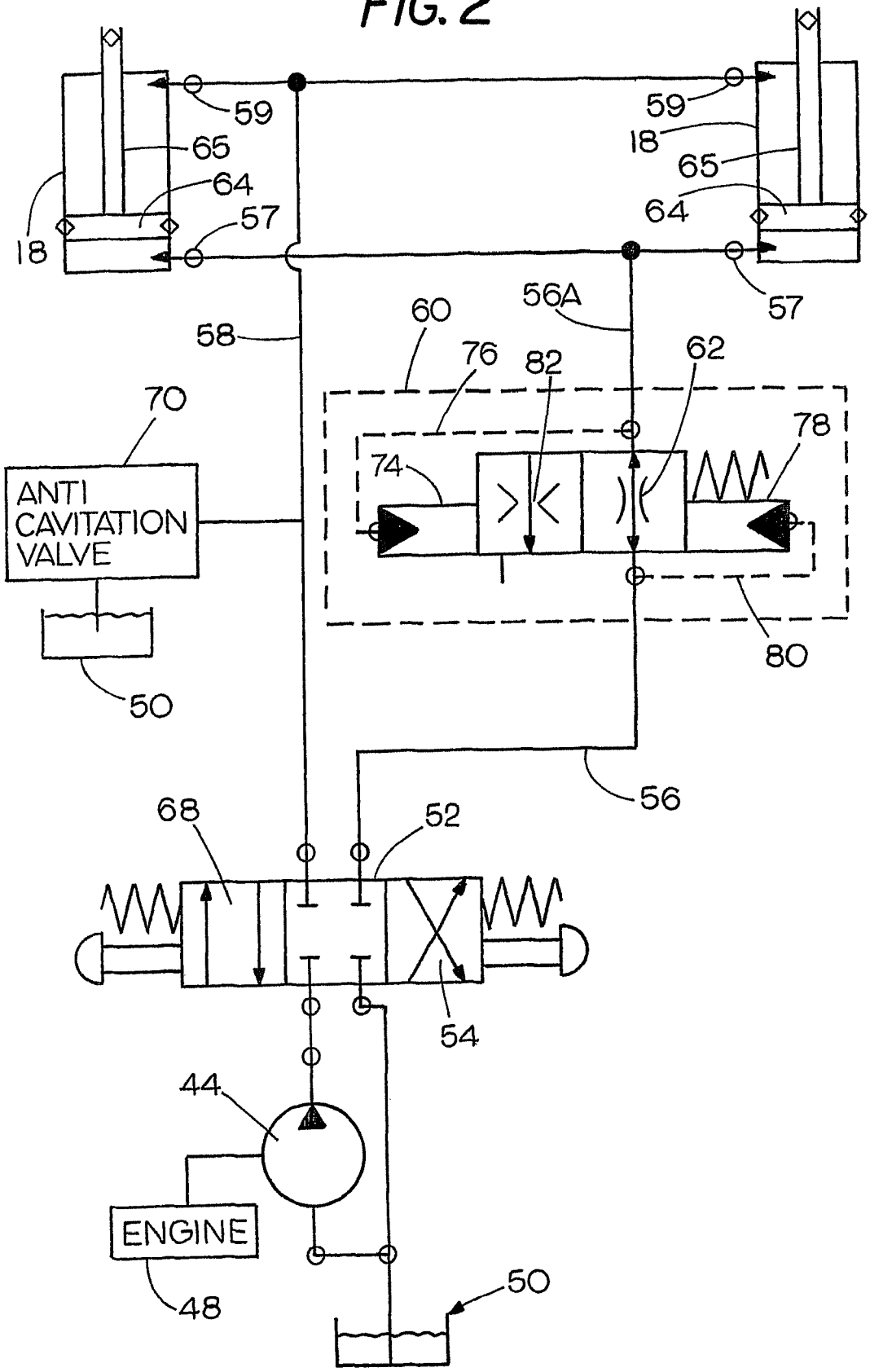
FIG. 2 is a schematic representation of the flow compensated valve of the present disclosure in a typical hydraulic circuit utilizing actuators that are for loader lift arms and which would be from time to time retracted under load.

In FIG. 2, a schematic representation of the hydraulic system for operating the lift actuators or cylinders 18 including the flow compensated valve of the present disclosure is shown. A simplified representation of a hydraulic pump 44 is driven by the loader engine, which is illustrated schematically at 48. A hydraulic reservoir 50 is also illustrated. A typical four way spool valve 52 is used for controlling the lift actuators, and a separate valve would be used for controlling the tilt actuators 28.

In one position of the spool valve 52, as schematically represented, first section 54 is aligned so that the pressure side or line of pump 44 would be connected an actuator base port flow line 56, and a rod end flow line 58 for the lift actuators 18 would be connected back to the reservoir or tank 50. Line 56 is connected to provide flow through the flow compensated valve 60 of the present disclosure. The flow compensated valve 60 is shown in its normal position in solid lines in FIG. 2, and in this position the line 56 is connected through a schematically represented control orifice 62, which permits a substantially free flow at the acceptable flow rate, for example, the rated pump flow of pump 44. The outlet side of the control orifice 62 is connected to a line 56A that is connected to first ports 57 at the base ends of the actuators 18, on the base side of the pistons 64 of the actuators 18. The pistons 64 move piston rods 65. Line 58 is connected to second ports 59 at the rod ends of the actuators 18 and this line does not connect to the flow compensated valve 60. In some cases actuators are retracted to lift a load and in such cases the connections from pump 44 would direct fluid under pressure to the rod ends for lifting a load.

With the spool valve 52 moved to the position where the connections indicated schematically in valve section 54 are aligned with lines 56 and 58 so that the fluid under pressure from pump 44 is introduced into line 56, the piston rods 65 of the actuators 18 will be extended, and the lift arm 16 will be raised along with the bucket 38, as generally shown in its dotted line position in FIG. 1. In a raised or partially raised position, normally the bucket would be dumped.

When the load indicated at dotted line 42 is dumped, the bucket would be empty, and when the spool valve 52 was shifted so that the connections indicated schematically in spool valve section 68 were aligned with the connections for lines 56 and 58, flow would be exhausted from the base or loading end ports of the actuators 18, through the line 56A, control orifice 62 and line 56 back to the tank or reservoir 50. Fluid under pressure would be provided through the line 58 from pump 44 to the rod ends of the actuators 18, or make up hydraulic oil can be provided from an anti-cavitation valve 70, (a one way check valve) which is connected to the reservoir 50 and would provide fluid in the line 58 to the rod ends of the actuators 18 without causing cavitation in the actuators or the lines.

When the loader arms 16 are under a load, and the bucket 38 is partially filled at least, and the bucket is to be lowered, the valve 52 is shifted to its lowering position, with the schematically shown valve section 68 aligned with the lines 58 and 56. The pistons 64 will tend to retract rapidly under the load from the bucket, causing a high return flow in line 56A. The control orifice 62, which is sized to permit flow at an acceptable rate, for example, compatible with the rated pump flow rate, creates a higher pressure in line 56A than in line 56, and this higher pressure caused by a flow greater than the acceptable or desired flow, acts to cause a valve element 74 carrying control orifice 62 to shift. A line 76 connected to line 56A schematically represents the application of pressure in line 56A on valve element 74. The valve element 74 has one portion or side open to the lower pressure in the line 56 that permits the flow compensated valve element 74 to shift or change state, and a restrictive flow orifice 82 is introduced between lines 56A and 56 when the valve element 74 shifts. The low pressure side of valve element 74 is represented by line 80. The restrictive flow orifice 82 reduces the flow through the lines 56 and 56A and controls the rate at which the pistons 64 can retract, even under heavy loads. The rod ends of the actuators 18 can be filled with oil provided by the anti-cavitation valve 70 from reservoir 50 as needed as the rods retract.

Figure 3:
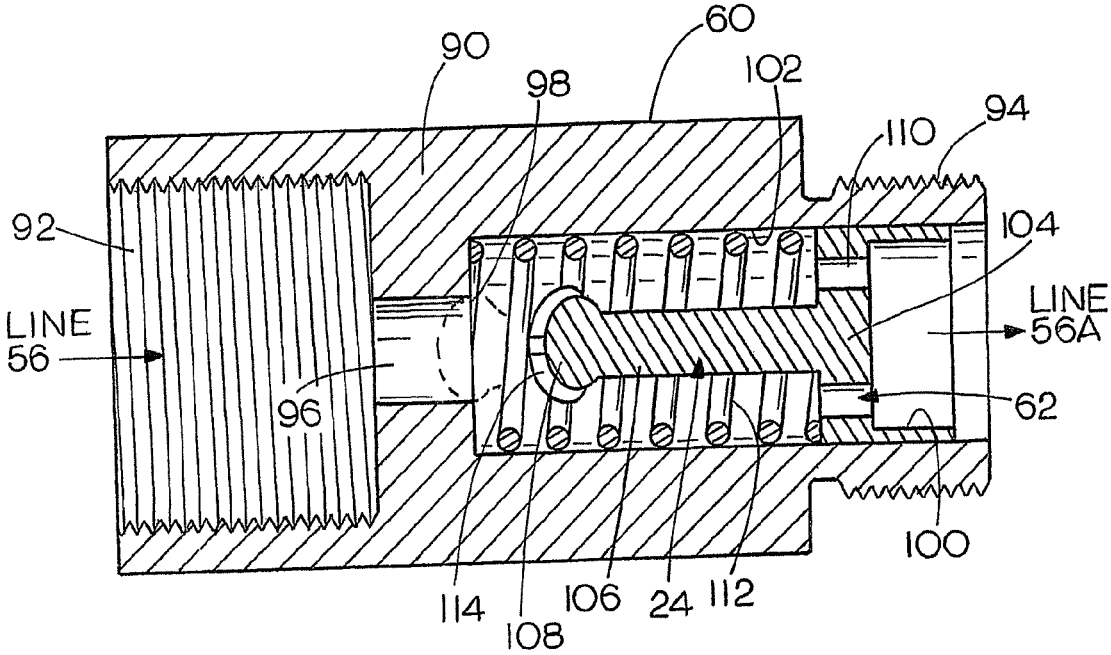
FIG. 3 is a longitudinal cross sectional view of an embodiment of the flow compensated valve.
Figure 4:
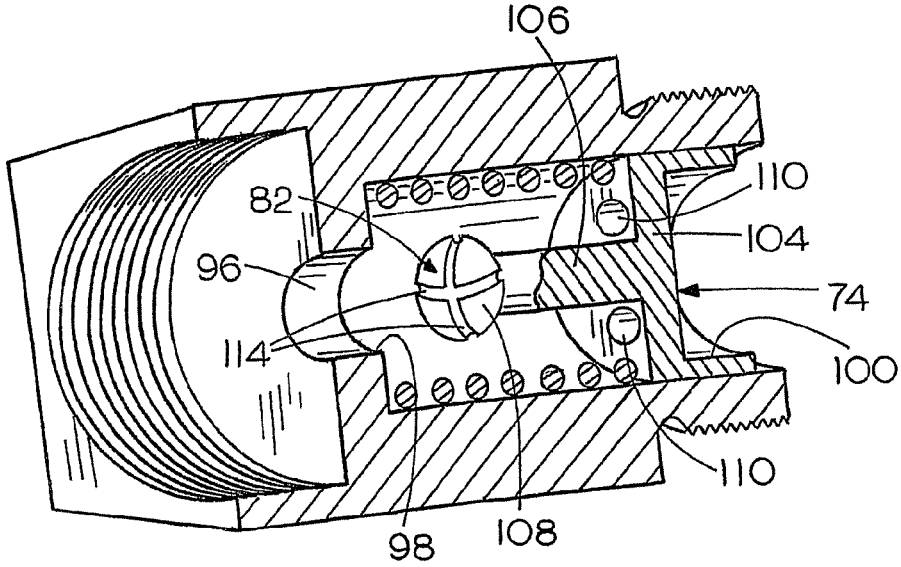
FIG. 4 is a perspective view of the flow compensated valve of FIG. 3 with parts in section and parts broken away.

FIGS. 3 and 4 illustrate an embodiment of a flow compensated valve usable for the purposes illustrated by the schematic representation in FIG. 2. A flow compensated valve 60 comprises a valve body 90, which has a threaded end bore 92 for connection to line 56, and a second end 94 for connection to line 56A. The valve body has an internal passage 96 forming a valve seat 98 surrounding the passage 96. Valve element 74 represented schematically in FIG. 2 is shown in a large bore 102, and valve element 74 includes a base sleeve 100 that slides in bore 102 formed in the valve body 90. The base sleeve 100 has an end wall 104 that supports a valve stem 106 with a valve head 108 at an outer end thereof. The wall 104 has a plurality of openings indicated at 110 that form the control orifice 62. There are a selected number of openings 110 that provide a flow path of size so that normal, acceptable flow through the line 56 and through the passage 96 into the valve bore 102 passes substantially unrestricted (without substantial back pressure) through the openings 110 forming the control orifice 62. A spring 112 is provided for urging the valve head 108 away from the seat 98, as shown in solid lines in FIG. 3, during flow for lifting the lift arms of the actuator, when the flow from line 56 passes through the flow control valve 60 to line 56A.

The valve head 108 has crossed slots 114 forming the restrictive orifice 82. When the valve head 108 is seated on the valve seat 98, these cross slots, which can be seen in FIG. 4 are sized so that the orifice flow path is of proper size to restrict flow through passage or bore 96 so that when the valve head seats against the valve seat 98, as shown in dotted lines in FIG. 4, the speed of retraction of an actuator, for example by dropping a loaded bucket, is kept at the desired level.

When the reverse flow from line 56A toward line 56 through the valve bore 102 and control orifice openings 110 causes a sufficient back pressure in the line 56A, the valve element 74 shifts so that the valve head 108 seats on the seat 98, and the only flow that is permitted is through the restrictive orifice 82, formed by the slots 114.

The shifting of the valve element 74 is controlled by the size of openings 110 and the spring 112, and the rate of actuator retraction or load descent is controlled by the size of the slots 114 that form the restrictive orifice 82.

The restrictive orifice can be designed to change state, or increase restriction as a variable function, that is, as the back pressure increases from the overrunning load, the orifice in the line becomes smaller. Stated another way, the flow restriction would become greater as the back pressure increased. There also can be a series of orifices, each a different size that would be effective in the return flow line sequentially as the back pressure increased. Thus changing the state of the flow compensated valve is not restricted to using one size orifice for all return flows that exceed an acceptable flow.

Again, the lift arm actuators 18 are illustrated as controlling lift arms of a loader, but the flow compensated valve can be utilized with any type of actuator which would at times be retracted under external loads (overrunning loads) and at other times would be retracted with light external loads. It also should be noted that the positioning of the actuators could be reversed so that fluid under pressure at the rod end ports lift or move a load under a force. In such a case, the rod end ports 59 would be considered the first ports for receiving fluid under pressure to lift or move a load.

It can be seen that the lift actuators 18 also can be retracted under pressure when the connection shown schematically in the valve section 68 connects the lines 56 and 58.

Supplying hydraulic oil for make up on the rod ends of the actuators from the anti-cavitation valve cuts down the need for pump flow to the rod ends without sacrificing the load control utilizing the present flow compensated valve. Engine power is no longer required to lower a light load or empty bucket, so that there is an improved machine efficiency over the prior systems that had a fixed restriction in the lift actuator system, particularly when lowering the lift arms after dumping the bucket or other load. The elimination of the requirement for using hydraulic pressure for lowering or reverse movement of the lift arm and an unloaded bucket frees up available horsepower for driving the vehicle or loader so that increased ground travel speed can be achieved when going from a dumping location back to the loading location. The load that is moved by pressurizing the actuators and which may cause opposite movement of the actuators can be any type of load.

Although the present invention has been described with reference to preferred embodiments, workers skilled in the art will recognize that changes may be made in form and detail without departing from the spirit and scope of the invention.

What is claimed is:

1. A hydraulic system for providing fluid under pressure to an actuator having an extendable and retractable piston rod and first and second ports, comprising:

a hydraulic fluid pressure source configured to draw hydraulic fluid from a reservoir and in communication with the actuator to move the piston rod in a first direction and in a second direction that opposes the first direction, and wherein a load on the actuator acts to move the piston rod in the second opposite direction in concert with the hydraulic fluid pressure source;

a control valve for directing hydraulic fluid under pressure from the hydraulic fluid pressure source to the actuator to move the piston rod; and a flow compensated valve carrying flow between the control valve and the first port of the actuator and having at least two flow states, a first flow state of the flow compensated valve providing flow from the hydraulic fluid pressure source to move the piston rod in the first direction and, when the hydraulic fluid pressure source and the load on the actuator are acting upon the piston rod to move it in the second direction, providing substantially unrestricted flow from the first port of the actuator below a selected flow rate, and a second flow state of the flow compensated valve for substantially restricting flow through the flow compensated valve to a selected flow rate, when the flow rate through the flow compensated valve exceeds the selected flow rate, detected as a pressure drop across the flow compensated valve.

2. The hydraulic system of claim 1 and further comprising an anti-cavitation valve connected between the hydraulic reservoir and the second port of the actuator.

3. The hydraulic system of claim 1, wherein the flow compensated valve has a control orifice carrying hydraulic fluid between the first port of the actuator and the control valve in the first flow state, the control orifice causing a back pressure to move the flow compensated valve to the second flow state when the flow rate from the first port to the flow compensated valve exceeds the selected flow rate.

4. The hydraulic system of claim 3, wherein said flow compensated valve has a pressure sensitive control that changes the flow compensated valve between its first and second flow states in response to differential pressure across the control orifice.

5. The hydraulic system of claim 3 wherein the flow compensated valve comprises a shiftable element, the element shifting between the first flow state in a first position and the second flow state in a second position of the element.

6. The hydraulic system of claim 1, wherein the hydraulic fluid pressure source comprises a hydraulic pump in fluid communication with the control valve to provide fluid under pressure to the actuator.

7. The hydraulic system of claim 1, wherein the actuator is a double acting actuator having a communication path from the second port to the control valve bypassing the flow compensated valve.

8. The hydraulic system of claim 7 and an anti-cavitation valve connected between the hydraulic reservoir and the second port of the actuator permitting withdrawal of hydraulic oil from the hydraulic reservoir as the piston rod moves in the second direction.

9. A loader having a frame and a lift arm pivotally coupled to the frame, the lift arm capable of being rotated about the frame by employing the hydraulic system of claim 1.

10. A loader having a frame and a lift arm pivotally coupled to the frame, an actuator for rotating the lift arm with respect to the frame, said actuator having an internal piston and a piston rod, and the actuator having first and second pressure ports, a control valve connected to a pump configured to draw hydraulic fluid from a reservoir, the control valve configured to selectively direct hydraulic fluid under pressure from the pump to the first and second pressure ports to position the lift arm, a flow compensated valve connected between the control valve and the first pressure port, said flow compensated valve having a first flow state for passing a flow of fluid under pressure at a first flow rate, and a second flow state for passing a flow of fluid under pressure at a second flow rate in response to an increase in pressure between the flow compensated valve and the first pressure port when the control valve is selected to direct hydraulic fluid from the pump to the second pressure port.

11. The loader of claim 10, wherein said flow compensated valve has a control orifice in the first flow state selected in size to pass the first flow rate of fluid flow from the first pressure port through the flow compensated valve and causing the flow compensated valve to select the second flow rate to carry flow from the first pressure port when back pressure between the first pressure port and the flow compensated valve exceeds a selected back pressure.

12. The loader of claim 10, wherein said flow compensated valve has a valve element, such that in the first flow state, fluid is passed through a control orifice with the valve element in a first position, the valve element forming a restrictive orifice in a second position, wherein differential pressure across the flow compensated valve caused by a flow rate from first pressure port to the flow compensated valve is greater than the first flow rate thereby moving the valve element to its second position.

13. The loader of claim 10 and further comprising an anti-cavitation valve connected between the hydraulic reservoir and the second pressure port, said anti-cavitation valve permitting hydraulic fluid to be removed from the hydraulic reservoir and flow to the second pressure port when the control valve directs hydraulic fluid under pressure from the pump to the second port.

14. A flow control for controlling maximum flows from an actuator configured to selectively receive hydraulic fluid under pressure from a pressure source at a first port to move a load in a first direction against a force tending to move the actuator in a second direction opposing the first direction and selectively receive hydraulic fluid under pressure from the pressure source at a second port to move the load in the second direction cooperatively with the force, a flow compensated valve in a line connected from the control valve to the first port, said flow compensated valve having two flow states, a first state carrying a flow of fluid through the flow compensated valve at a first rate, and said flow compensated valve being changed to a second flow state to restrict flow through the flow compensated valve to a second rate when flow of fluid from the first port to the flow compensated valve exceeds a selected amount, resulting in a pressure buildup between the first port and the flow compensated valve.

15. The flow compensated valve of claim 14 wherein said actuator is connected to lift a load carried by a lift arm of a loader as the load is moved in the first direction.

16. The flow compensated valve of claim 15 wherein the flow compensated valve is operable to change the flow state of the flow compensated valve to the second flow state when a pressure from the first port to the flow compensated valve is greater than a selected pressure.

17. A method for providing overrunning load protection for a loader having a lift arm, a hydraulic actuator for raising and lowering the lift arm, said actuator having an internal piston and a piston rod, and the actuator having first and second pressure ports, the method comprising connecting a control valve to a pump for selectively directing hydraulic fluid under pressure from the pump to the first and second pressure ports to position the lift arm, connecting a flow compensated valve in the line between the control valve and the first pressure port, providing a first flow state in the flow compensated valve for passing a flow of fluid under pressure at a first flow rate and a second flow state for passing a flow of fluid under pressure at a second flow rate when a flow rate of fluid from the first pressure port to the flow compensated valve exceeds a selected flow rate greater than the first flow rate when the control valve directs hydraulic fluid under pressure from the pump to the second pressure port.

18. The method of claim 17, including providing a control orifice in the flow compensated valve selected in size to pass a flow of fluid under pressure at the first flow rate from the first pressure port and to cause a further restriction of flow in the flow compensated valve when back pressure between the first pressure port and the flow compensated valve exceeds a selected back pressure.

19. The method of claim 17 including providing a shiftable valve element in said flow compensated valve forming a control orifice when in a first position of the flow compensated valve and moving the valve element to a second position to form a more restrictive orifice in the flow compensated valve when the flow rate of fluid from the first pressure port to the flow compensated valve exceeds a selected flow rate greater than the first flow rate.

* * * * *